United States Patent [19]

Kaynor et al.

[11] 4,011,824

[45] Mar. 15, 1977

[54] COMPETITION SAILING JACKET

[75] Inventors: Margaret Kaynor; Peter Branning; Bruce Nolan, all of Miami, Fla.

[73] Assignee: Florida Sailing Systems, Inc., Miami, Fla.

[22] Filed: Dec. 10, 1975

[21] Appl. No.: 639,419

[52] U.S. Cl. ..... 114/270; 2/102; 114/39; 114/121

[51] Int. Cl.[2] ..... B63B 9/08

[58] Field of Search ..... 114/.5 R, 39, 121; 2/2, 92, 22, 102

[56] References Cited

UNITED STATES PATENTS

| | | | |
|---|---|---|---|
| 5,110 | 10/1872 | Lear | 2/92 |
| 1,128,122 | 2/1915 | Fox | 2/22 |
| 1,225,354 | 5/1917 | Pierce | 2/22 |
| 1,670,239 | 5/1928 | Cline | 2/2 |

*Primary Examiner*—Trygve M. Blix
*Assistant Examiner*—Sherman D. Basinger
*Attorney, Agent, or Firm*—Eugene M. Cummings

[57] ABSTRACT

A sailing jacket for use by a sailor in competition sailing includes a plurality of identical vest sections. Each vest section has an inner panel and an outer panel joined together along their margins to form an interior compartment. A mass of water absorbent material is disposed within the compartment such that when the jacket is wetted a predetermined increase in weight becomes available to the sailor for use as trim ballast for improving the operating efficiency of his sailboat.

9 Claims, 4 Drawing Figures

COMPETITION SAILING JACKET

BACKGROUND OF THE INVENTION

The present invention relates generally to functional wearing apparel, and more particularly to a detachable sailing jacket useful in providing ballast or trim weight for improved operation of a sailboat.

In competitive sailing it is incumbent on the sailor of a sailboat to obtain maximum performance from his craft. This is particularly true in one-design competition, wherein all of the competing boats are identical in sail area and hull design and only the skill of the sailor remains as a variable factor.

One method of improving the efficiency of a sailboat is to keep the sail as erect as possible into the wind. To this end, in smaller sized one-design sailboats the sailor may lean out away from the deck in a direction which tends to bring the sail upright, thereby compensating for at least a portion of the heeling effect of the wind. This technique is particularly advantageous when sailing windward, although experienced sailors find the technique useful at all points of sail.

In certain sailing situations, particularly when the wind is blowing strong, it is desirable to provide more compensating force on the sail than is available from the sailor's body weight. This additional compensation is obtained by the sailor carrying on his person one or more additional weights which compliment his body weight. Under International Yacht Racing Union (I.Y.R.U.) rules governing competitive sailboat racing the additional weight which may be thus carried is limited to a maximum of 20 kiolgrams, including a sailor's clothes and equipment, subject to modification for individual classes and designs of sailboats. For example in the Laser class of sailboat the maximum weight which may be carried by the sailor is 11 kilograms, or approximately 24 pounds. Allowing approximately 8.5 pounds for typical clothing, it follows that approximately 15.5 pounds or 7 kilograms may be carried as optional ballast or trim weight.

Various fixed-weight vests and belts have been proposed for this purpose which have had the disadvantage of requiring the sailor to decide in advance of starting the race whether to carry addtional weight. In the event that the additional weight was not required for the race the performance of the boat was unnecessarily handicapped by the presence of the useless trim ballast.

One attempt to overcoming this limitation involved a jacket-like garment worn by the sailor which contained a plurality of pockets in which plastic bottles or containers were contained. To obtain additional trim weight for the race the sailor could fill the bottles with water. While this did provide a controllable trim ballast, the resulting jacket configuration was undesirably bulky, both in its weighted and unweighted states.

Another attempt at obtaining additional ballast or trim weight involved the use of multiple layers of clothing such as sweatshirts or T-shirts which could be soaked with water. Not only did these not provide a predictable increase in trim weight, but they were also hard to put on and take off, making them dangerous in the event of the sailor falling overboard. Furthermore, because of their bulk they tended to interfere with the sailor in his operation of the sailboat.

Thus, a need has existed for a sailing jacket for competitve sailing which is compact so as to allow maximum freedom of movement to a sailor, and which can be conveniently and quickly converted from a lightweight garment to a garment having a predictable weight when sailing conditions require.

Accordingly, it is a general object of the present invention to provide a new and improved sailing jacket for competitive sailing.

It is a more specific object of the present invention to provide a new and improved sailing jacket for competition sailing which provides a controlled and predetermined weight.

It is another object of the present invention to provide a new and improved sailing jacket for competition sailing which can be quickly and easily put on and taken off.

It is another object of the present invention to provide a new and improved sailing jacket for competition sailing which is lightweight and compact so as not to interfere with the movements of its user.

SUMMARY OF THE INVENTION

The invention is directed to a competition sailing jacket which provides a desired predetermined trim weight when wetted. The jacket comprises at least one vest section including an inner panel and an outer panel joined together along their margins to form an interior compartment, at least one of the panels being formed of a relatively loosely woven fabric allowing water to pass therethrough, a mass of water abosorbent material disposed within the compartment, the weight of the water capable of being abosorbed by the mass providing at least a portion of the desired predetermined trim weight, and fastening means for securing the vest section to the body of a user.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
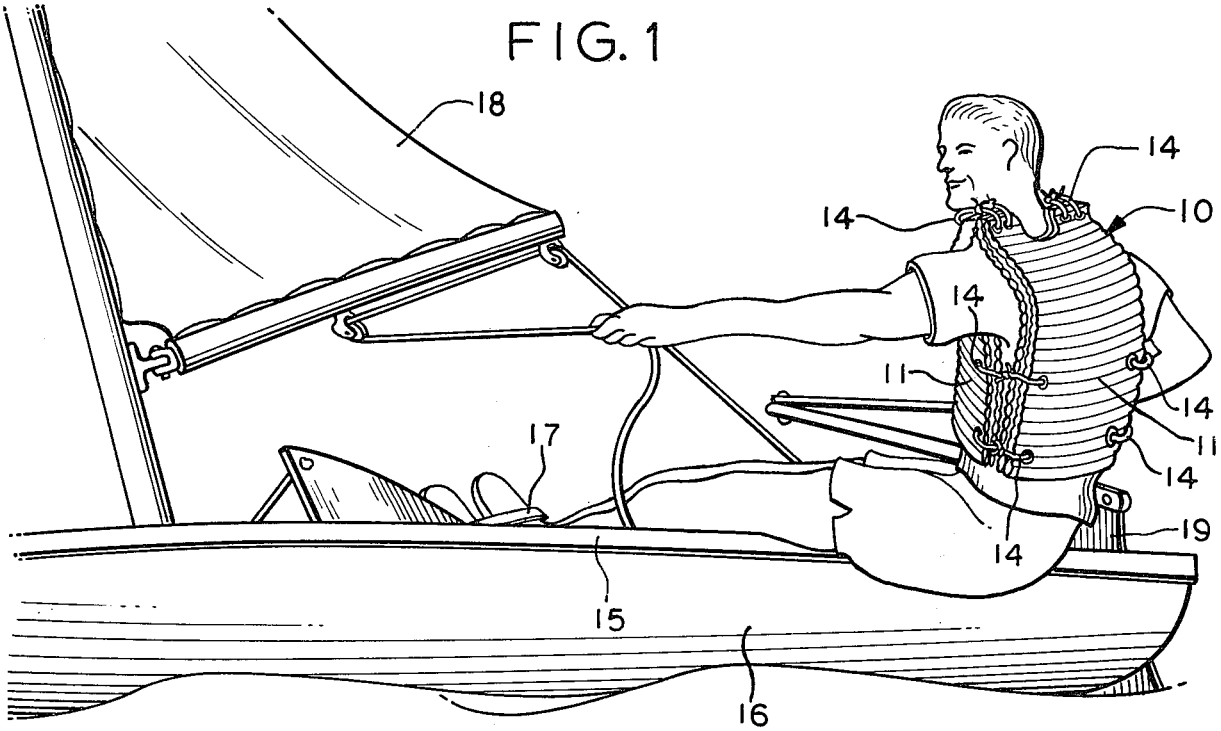
FIG. 1 is a perspective view of the deck portion of a sailboat showing the use of a sailing jacket constructed in accordance with the invention.
Figure 2:
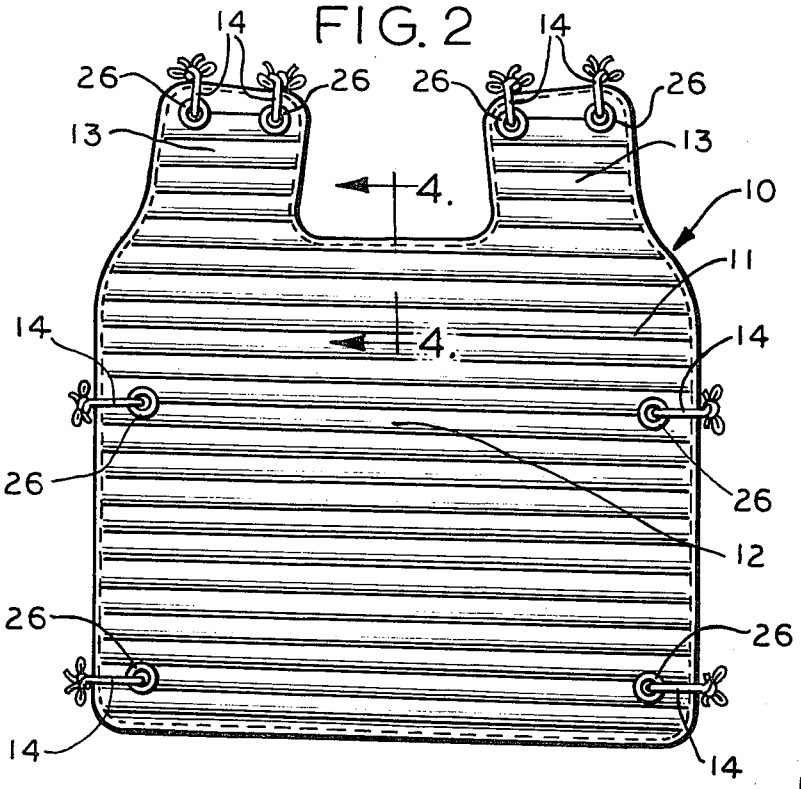
FIG. 2 is a front elevational view of the sailing jacket partially broken away to show the construction of the jacket.
Figure 3:
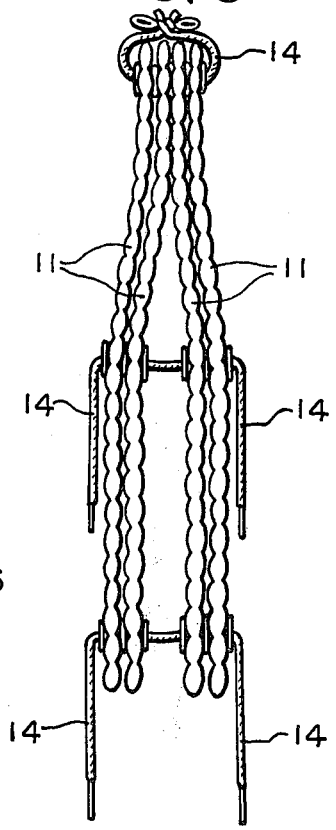
FIG. 3 is a side-elevational view of the sailing jacket showing the use of four identical vest sections to obtain a predetermined ballast or trim weight.

Referring to the figures, and particularly to FIGS. 1–3, a competition sailing jacket 10 constructed in accordance with the invention is seen to comprise a plurality of individual vest sections 11 each designed to absorb a predetermined mass of water when wetted, and to thus assume a predetermined increased weight which may be utilized by the sailor and/or crew memebers as trim ballast when conditions warrant.

As best seen in FIG. 2, the vest sections are preferably identical in design and construction and are each shaped in the form of a half vest, having a central chest portion 12 and a pair of upper spaced-apart shoulder portions 13.

As shown in FIG. 1, in use a plurality of individual vest sections 11 are secured over the shoulders and under the arms of the sailor by means of readily removable ties 14. Thus secured, to bring the additional ballast or trim weight of the jacket 10 into use it is only necessary for the sailor to saturate the vest sections with water and lean out over the windward edge of the deck 15 of the sailboat 16 as shown in FIG. 1, thereby giving the water-saturated jacket the maximum possible moment arm with respect to the longitudinal axis of the sailboat. In practice this is accomplished by the sailor securing his ankles under a hiking strip 17 attached to the cockpit of the boat and, while sitting on the edge of the deck, leaning windward. The sail 18 of the sailboat is typically controlled with one hand and the rudder 19 of the sailboat with the other hand. The resulting additional compensating force exerted about the longitudinal axis of the sailboat by the water-saturated sailing jacket 10 tends to right the sail 18 for greater sailing efficiency.

Figure 4:
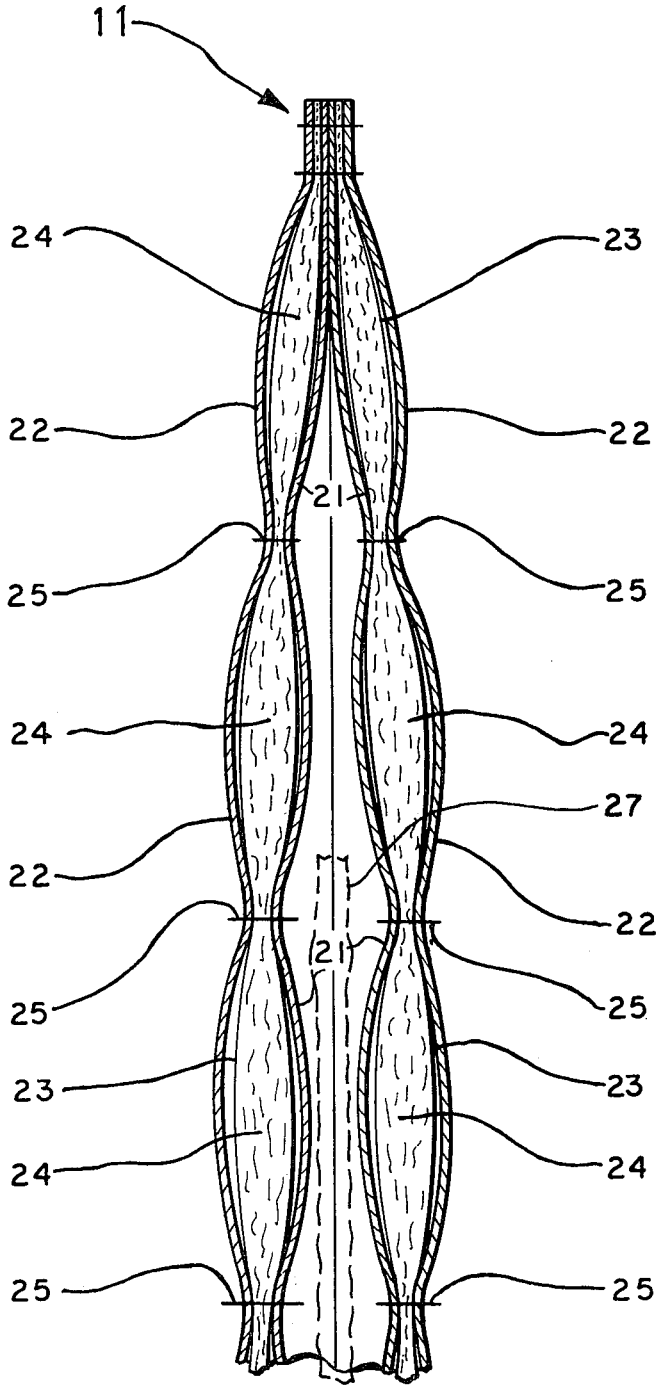
FIG. 4 is a cross-sectional view taken along line 4—4 of FIG. 2 showing the interior of a vest section.

Referring to FIG. 4, each of the vest sections 11 comprises two layers each having an inner panel 21 and an outer panel 22 joined along their margins to form an interior compartment 23. At least the outer panels in each layer are formed of a relatively loosely woven cloth material such as polyester and cotton or canvas which allows water to freely enter the compartment of that layer. A mass of water-absorbent material 24 is contained in the compartments of the vest sections. This material is preferably arranged in the form of a blanket, and the panels are preferably quilted or stitched together at regular intervals to form seams 25 for preventing the blanket from bunching or otherwise becoming re-arranged within compartment 23.

Prior to use of the sailing jacket 10 it is necessary that the blankets of water-absorbent material 24 in the vest sections be saturated with water. Since a predetermined mass of this material is present in each vest section and the weight of the water the material can retain when saturated is known, the water-saturated weight of each vest section, and hence the water-saturated weight of the sailing jacket can be accurately predicted. In practice, a medium adult-sized vest section constructed for Laser class competition with cloth panels and water absorbent blankets of cotton batting material one inch think has a dry weight of 1 pound and a water-saturated weight of 5 pounds. When wearing a sailing jacket comprised of two such sections a sailor carries a total dry weight of 2 pounds and has available a trim weight of 10 pounds should he decide to water-saturate the jacket.

To enable the individual vest sections 11 to be secured together to form the sailing jacket 10 a plurality of eyelets 26 are provided along the sides of each vest section. As shown in FIG. 2, pairs of such eyelets 26 may be provided at the top end of each of the upper shoulder portions 13 and at spaced locations along the sides of the center chest portion 12. Individual ties 14 are passed through these eyelets and tied together by means of slip knots or other appropriate fastening means to secure the jacket during use while allowing it to be readily detached by the user should that become necessary.

It will be appreciated that other fastening means may be employed to secure the vest sections together. For example, where the use of only two vest sections is contemplated snapless self-gripping fasteners such as those marketed under the trade name "Velcro" may be provided on the shoulder portions and on opposite sides of the center chest portion of the two vest sections. Furthermore, while cotton batting has been found to provde a good ratio of wet weight to dry weight, it will be appreciated that other water-absorbent materials such as polyester fiber batting may be utilized instead.

Although four vest sections 11 are shown as forming the sailing jacket 10 shown in FIGS. 1–3, it will be appreciated that a greater or lesser number of such vest sections may be employed as necessary. That is, for heavy wind conditions wherein a relatively large amount of trim ballast is required the sailor may elect to wear a sufficient number of vest sections to obtain the greatest allowable trim weight. However, under light wind conditions the sailor may elect to wear only one or two vest sections for lesser trim weight.

It is contemplated that the vest sections 11 may be fabricated in various sizes and weights to accomodate the preferences of different users and the requirements of different classes of boats. The water-saturated weight of the vest sections can be increased by either increasing the thickness of the blanket of water absorbent material 24 or by providing additional layers or blankets of the material 24 within compartment 23. Also, an additional layer 27 of water absorbent material can be positioned between the inner panels 21 of a vest section to obtain an incremental increase in water-saturated weight. Providing such an additional layer in one of the illustrated Laser class vest sections 11 increases the water-saturated weight of each 1 pound dry — 5 pound wet vest section to approximately 7¾ pounds or 3.5 kilograms. By wearing a sailing jacket comprised of two such vest sections a sailor has a total trim ballast of approximately 15.5 pounds or 7 kilograms available to him for use during a race.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A competition sailing weight jacket providing a desired predetermined trim weight when wetted, said jacket comprising, in combination:

at least one vest section having two substantially identical layers, each of said layers including substantially identical inner and outer panels joined together along their margins to form interior compartments, at least one of said panels being formed of a relatively loosely woven fabric allowing water to pass therethrough, said layers being joined together along at least a portion of their margins to form an additional compartment therebetween;

first and second blanket-like masses of water absorbent material disposed within respective ones of said compartments, the weight of the water capable of being absorbed by said masses providing a predetermined portion of said desired predetermined trim weight, said inner panels being cross-stitched to respective ones of said outer panels to hold said water absorbent material in position; and fastening means for securing said vest section to the body of a user.

2. A competition sailing weight jacket as defined in claim 1 comprising identical front and rear vest sections each including a central chest portion and a pair of upper shoulder portions, and wherein said fastening means join corresponding shoulder portions and sides of said chest portions of said vest sections to secure said jacket over the shoulders and around the waist of a user.

3. A competition sailing weight jacket as defined in claim 1 wherein said panels are formed from canvas and said water absorbent material comprises a cotton batting material.

4. A competition sailing weight jacket as defined in claim 1 comprising an additional blanket-like mass of water absorbent material disposed within said additional compartment for providing an additional portion of said desired predetermined trim weight.

5. A competition sailing weight jacket as defined in claim 4 wherein said layers are joined along only a portion of their margins to provide access to said additional compartment, and said additional mass of water absorbent material is removable from said additional compartment to effect changes in the effective trim weight of said jacket.

6. A competition sailing jacket providing a desired predetermined trim weight when wetted, said jacket comprising, in combination:

substantially identical front and rear vest sections each having two substantially identical layers, each of said layers, including substantially identical inner and outer panels joined together along their margins to form interior compartments and formed of a relatively loosely wove fabric allowing water to pass therethrough, said layers being joined together along a portion of their margins to form an open-ended compartment therebetween;

first and second masses of water absorbent material disposed within respective ones of said compartments, the weight of the water capable of being absorbed by said masses providing a predetermined portion of said desired predetermined trim weight, said inner panels being cross-stitched to respective ones of said outer panels to hold said water absorbent material in position; and fastening means for securing said vest sections to the body of a user.

7. A competition sailing weight jacket as defined in claim 6 having an additional blanket-like mass of water absorbent material removably disposed within said open-ended compartment for providing an additional portion of said desired predetermined trim weight.

8. A competition sailing weight jacket as defined in claim 6 wherein said vest sections each include a chest portion and shoulder portions, and wherein said fastening means include eyelets disposed on at least said shoulder portions and sides of said chest portions, and a plurality of flexible ties extending between corresponding eyelets of said vest sections.

9. A competition sailing weight jacket as defined in claim 6 wherein said panels are formed of canvas and said water absorbent material comprises a cotton batting material.

* * * * *